United States Patent [19]

Takase et al.

[11] 4,227,507

[45] Oct. 14, 1980

[54] AIR/FUEL RATIO CONTROL SYSTEM FOR INTERNAL COMBUSTION ENGINE WITH AIRFLOW RATE SIGNAL COMPENSATION CIRCUIT

[75] Inventors: Sadao Takase, Yokohama; Masaharu Asano; Nobuzi Manaka, both of Yokosuka, all of Japan

[73] Assignee: Nissan Motor Company, Limited, Yokohama City, Japan

[21] Appl. No.: 896,136

[22] Filed: Apr. 13, 1978

[30] Foreign Application Priority Data

Apr. 15, 1977 [JP] Japan ..... 52/42500

[51] Int. Cl.[3] ..... F02B 3/00

[52] U.S. Cl. ..... 123/492; 123/493; 123/494; 123/440

[58] Field of Search ..... 123/32 EA, 32 EH, 32 EL, 123/32 EJ, 32 EE, 119 EC

[56] References Cited

U.S. PATENT DOCUMENTS

| | | | |
|---|---|---|---|
| 3,673,989 | 7/1972 | Aono et al. | 123/127 X |
| 3,759,231 | 9/1973 | Endo | 123/32 EH |
| 3,823,696 | 7/1974 | Mutschler et al. | 123/32 EJ |
| 4,051,818 | 10/1977 | Volckers | 123/32 EJ |
| 4,075,982 | 2/1978 | Asano et al. | 123/32 EL X |
| 4,126,107 | 11/1978 | Harada et al. | 123/32 EL X |
| 4,127,086 | 11/1978 | Harada et al. | 123/32 EL |
| 4,144,847 | 3/1979 | Hosaka | 123/32 EE |

*Primary Examiner*—Tony M. Argenbright

*Attorney, Agent, or Firm*—Robert E. Burns; Emmanuel J. Lobato; Bruce L. Adams

[57] ABSTRACT

An air flow rate compensation circuit is provided to compensate for an erroneous air flow rate signal produced in response to the movement of the flap of an air flow meter disposed in the intake air passage of an internal combustion engine where the erroneous nature of the signal occurs because of an overshoot characteristic of the flap. The compensation circuit produces an output signal with which either an air/fuel ratio control signal produced in response to the air flow rate signal or the air flow rate signal per se is modified where the output signal is produced in response to the movement of the throttle valve or the variation of the air flow rate signal.

10 Claims, 20 Drawing Figures

AIR/FUEL RATIO CONTROL SYSTEM FOR INTERNAL COMBUSTION ENGINE WITH AIRFLOW RATE SIGNAL COMPENSATION CIRCUIT

FIELD OF THE INVENTION

The present invention generally relates to either an open or a closed loop air/fuel ratio control system for an internal combustion engine, and more specifically to such a system with a circuit for compensating for the transient characteristic of an air-flow meter.

BACKGROUND OF THE INVENTION

An air/fuel ratio control system for an internal combustion engine is becoming increasingly important with respect to the control of noxious emissions from the engine. In such a system, engine parameters such as intake air flow rate, engine rotational speed and engine temperature are detected for determining the air/fuel ratio. Moreover, if the system is equipped with a feedback system, a gas sensor is provided in order to detect the concentration of a component contained in the exhaust gases where the sensor output is utilized for precisely regulating the air/fuel ratio of the air-fuel mixture supplied to the engine.

The fuel supplying means for an internal combustion engine is usually a carburetor or an injection system. In the case of a carburetor, the fuel flow rate is basically determined by the magnitude of the vacuum in the venturi disposed in the intake manifold. However, in an injection system, an air flow meter is usually employed for detecting the flow rate of the intake air and producing a signal indicative thereof, this signal being used to control the fuel flow rate through the injection system. While such an air flow meter is essential in the injection system it can also be advantageously employed with a carburetor to precisely modify the air/fuel ratio of the air-fuel mixture producing therein.

An air flow meter consists of a rotatable or pivotal flap disposed in the intake passage where the flap is mechanically connected to a movable contact of a potentiometer. The flap is arranged to rotate against the biasing force of a spring under the influence of the pressure difference on the upstream side of the flap and the downstream side of same. The potentiometer is arranged to produce an output signal the voltage of which is indicative of the angular displacement of the flap and which is utilized for control of the air/fuel ratio control system.

In such an air flow meter, a damper or a damping device is employed for reducing the flactuation of the movement of the flap. However, when the air flow rate increases abruptly, the movement of the flap is apt to be excessive to produce an overshoot phenomena and thus the potentiometer connected thereto produces an output signal indicative of an air flow rate which is higher than the actual air flow rate. This erroneous signal causes the air/fuel ratio control system to supply a higher rate of fuel flow than necessary so that the air-fuel mixture becomes richer than a predetermined or desired value. Although a closed loop type air/fuel ratio control system is basically advantageous for avoiding undersirable influences of engine parameters, the closed loop system is easily influenced by such an erroneous signal since a time delay is inherent therein. The undesirably enriched air-fuel mixture causes an increase of the concentration of toxic components in the exhaust gases and also a decrease in the efficiency of a catalytic converter (if a three-way type), if disposed, in the exhaust system since such a catalytic converter exhibits its maximum efficiency when the air/fuel ratio of the air-fuel mixture is within a narrow range (usually close to the stoichiometric value). Such an overshoot of the flap of the air flow meter also occurs when the intake air flow rate decreases abruptly and thus the potentiometer produces an erroneous signal in the same manner.

The above mentioned undesirable overshoot characteristics of the flap of the air flow meter can be reduced to a negligible extent by designing and adjusting the damper or the damping device carefully and precisely. However, such an air flow meter requires a complex construction and time consuming adjustment of same. Therefore, the above mentioned provision of a complex damper for the reduction of the overshoot characteristics causes an increase in the cost of the air flow meter.

SUMMARY OF THE INVENTION

The present invention has been developed in order to remove above mentioned drawbacks of the air flow meter. According to the present invention, an electronic compensation circuit is provided for modifying the output signal of an air flow rate signal generator, such as a potentiometer the movable contact of which is mechanically connected to the flap of the air flow meter, or modifying the control signal produced in a control circuit which produces the control signal in response to the signal derived from the air flow rate signal generator and other engine parameters.

The air flow rate signal compensation circuit produces an output signal in response to the variation of the angular displacement of the throttle valve or the output signal of the air flow rate signal generator. This means that the compensation signal is produced upon the variation of the intake air flow rate and thus either a modified control signal is produced in the control circuit with which the air/fuel ratio is controlled, i.e., the air-fuel mixture is impoverished or enriched or the air flow rate signal per se is modified so as to reduce the erroneous nature thereof.

It is therefore, an object of the present invention to provide an air/fuel ratio control system equipped with an air flow meter wherein the overshoot characteristics of the flap of the air flow meter are electronically compensated for.

A further object of the present invention is to provide such a system with which the air/fuel ratio of the air-fuel mixture supplied to the engine is desirably regulated even upon a sudden acceleration or a deceleration.

Yet another object of the present invention is to provide such a system in which the damping device of the air flow meter does not require a complex construction.

BRIEF DESCRIPTION OF THE PREFERRED EMBODIMENTS

The objects and the features of the present invention will become readily apparent from the following detailed description taken in conjunction with the accompanying drawings in which.

Figure 3:
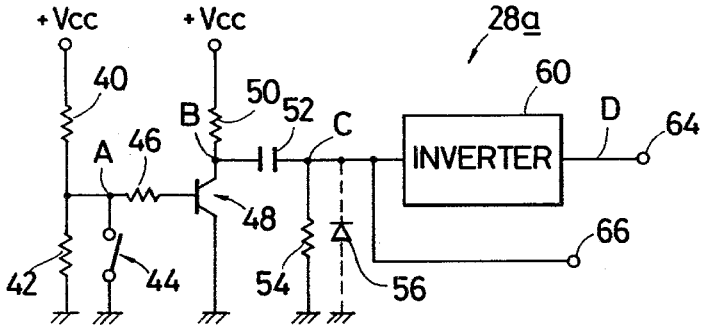
FIG. 3 shows a first possible circuit of the air flow rate signal compensation circuit shown in FIG. 1.
Figure 5:
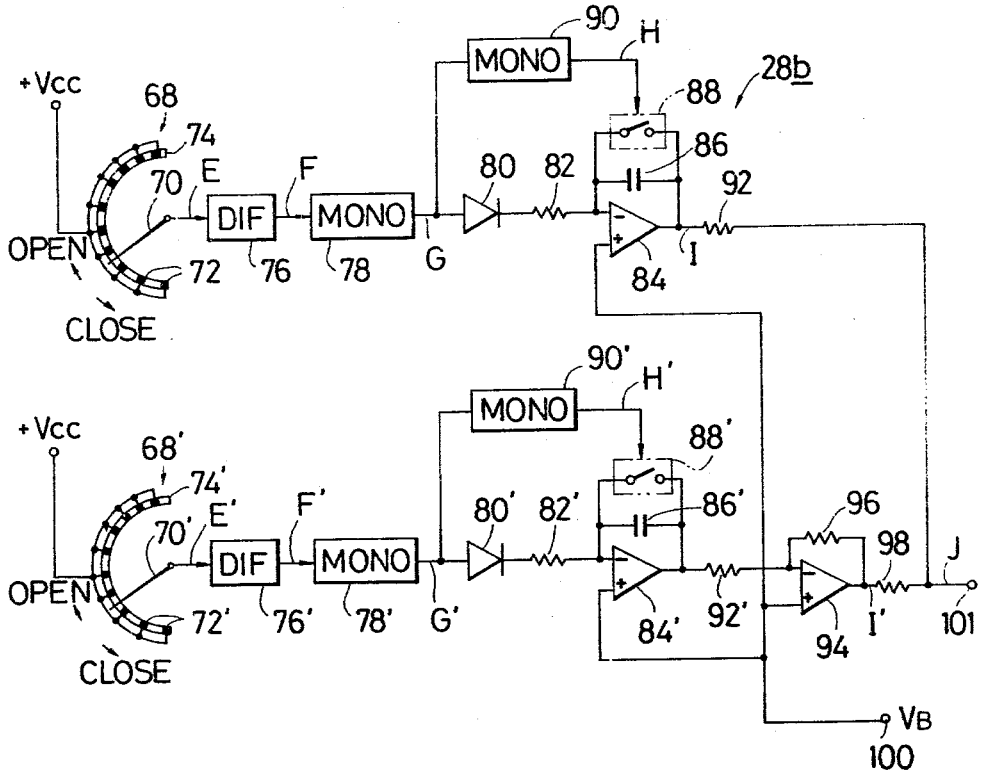
FIG. 5 shows a second possible circuit of the air flow rate signal compensation circuit shown in FIG. 1.
Figure 9:
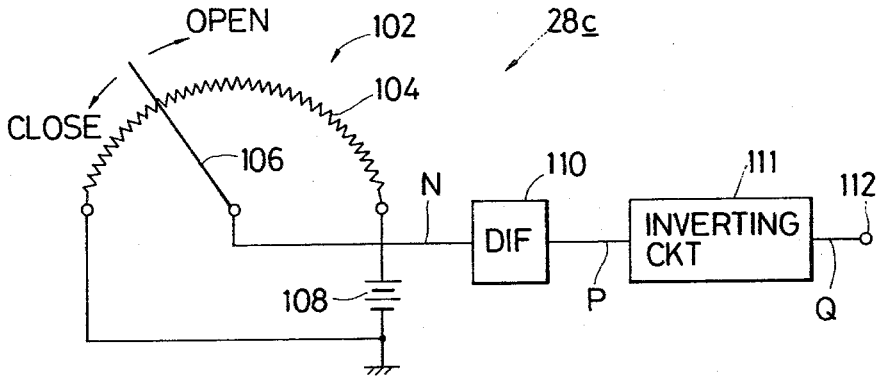
FIG. 9 shows a third possible circuit of the air flow rate signal compensation circuit shown in FIG. 1.
Figure 10A:
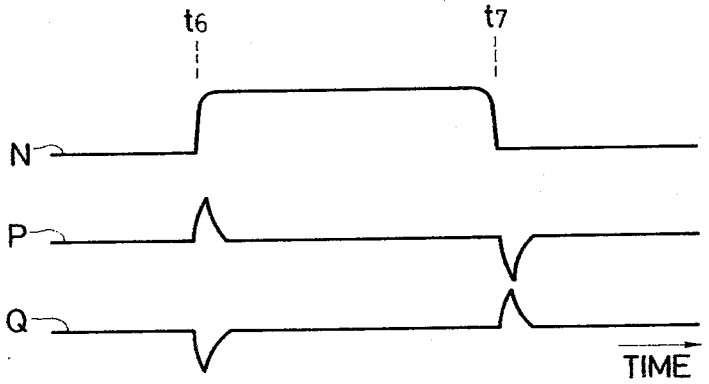
Figure 10B:
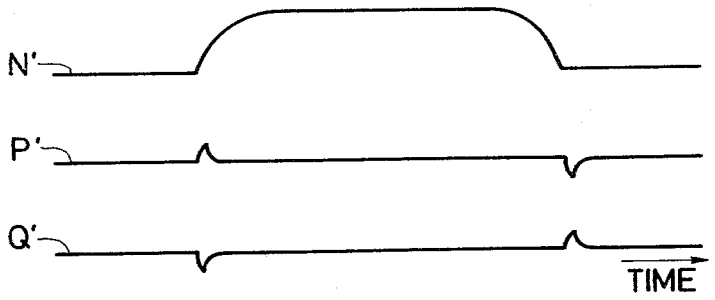
Figure 11:
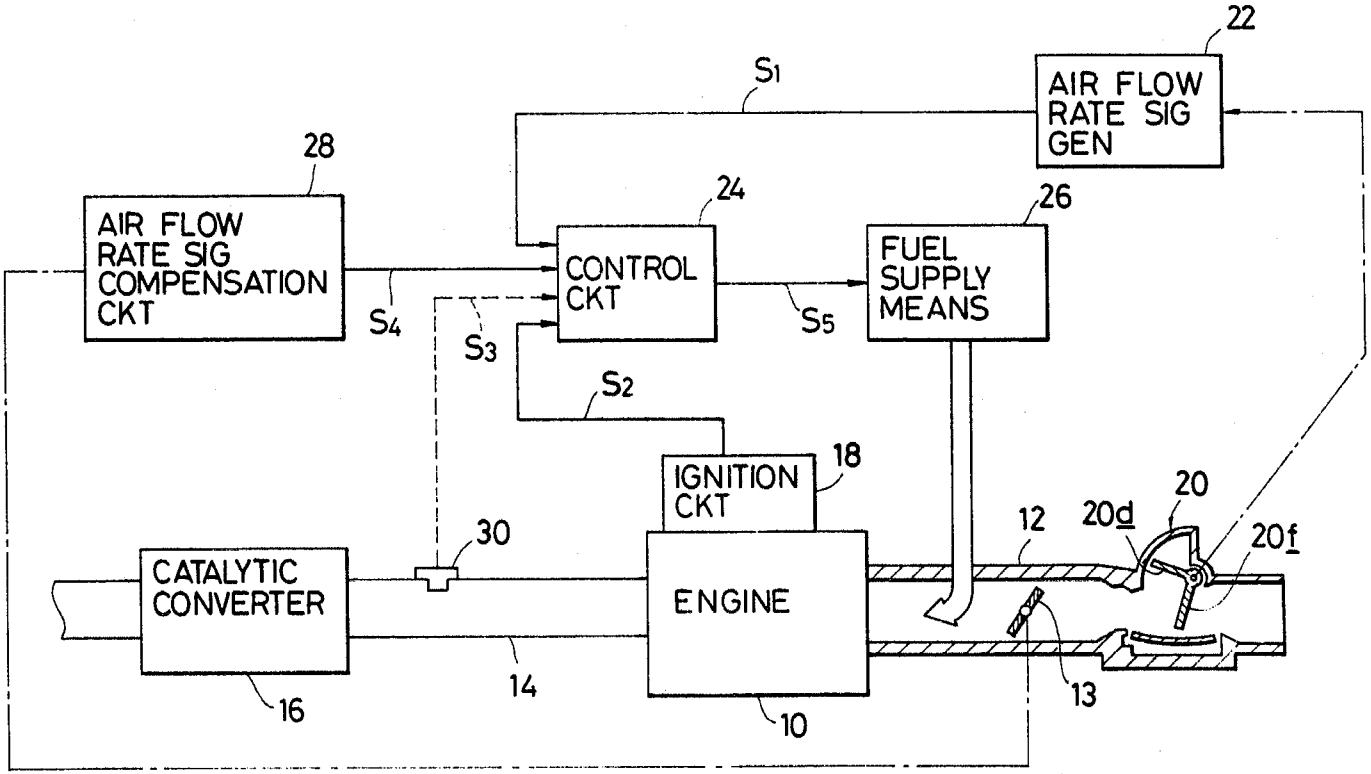
Figure 12A:
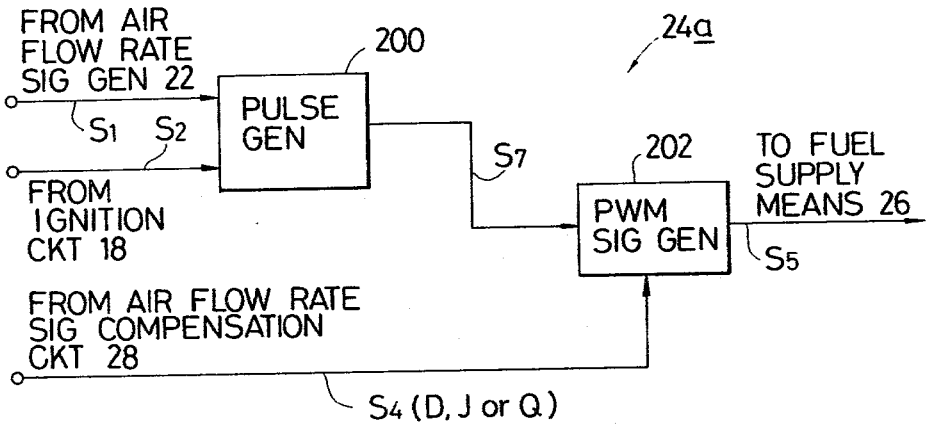
Figure 12B:
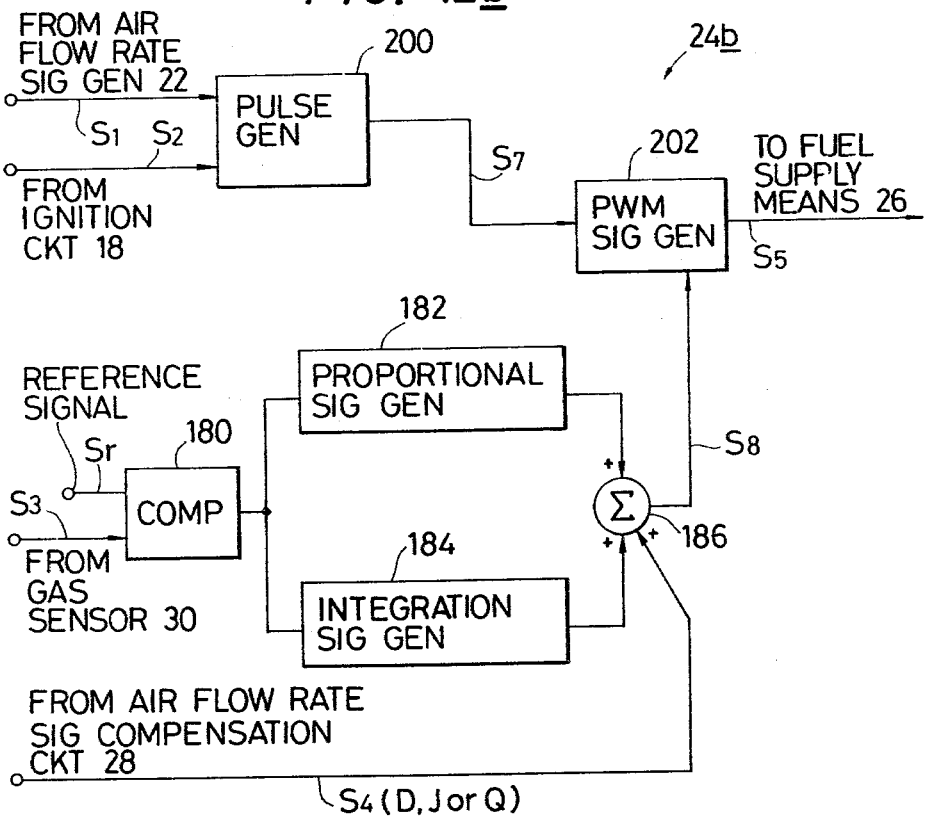
Figure 14:
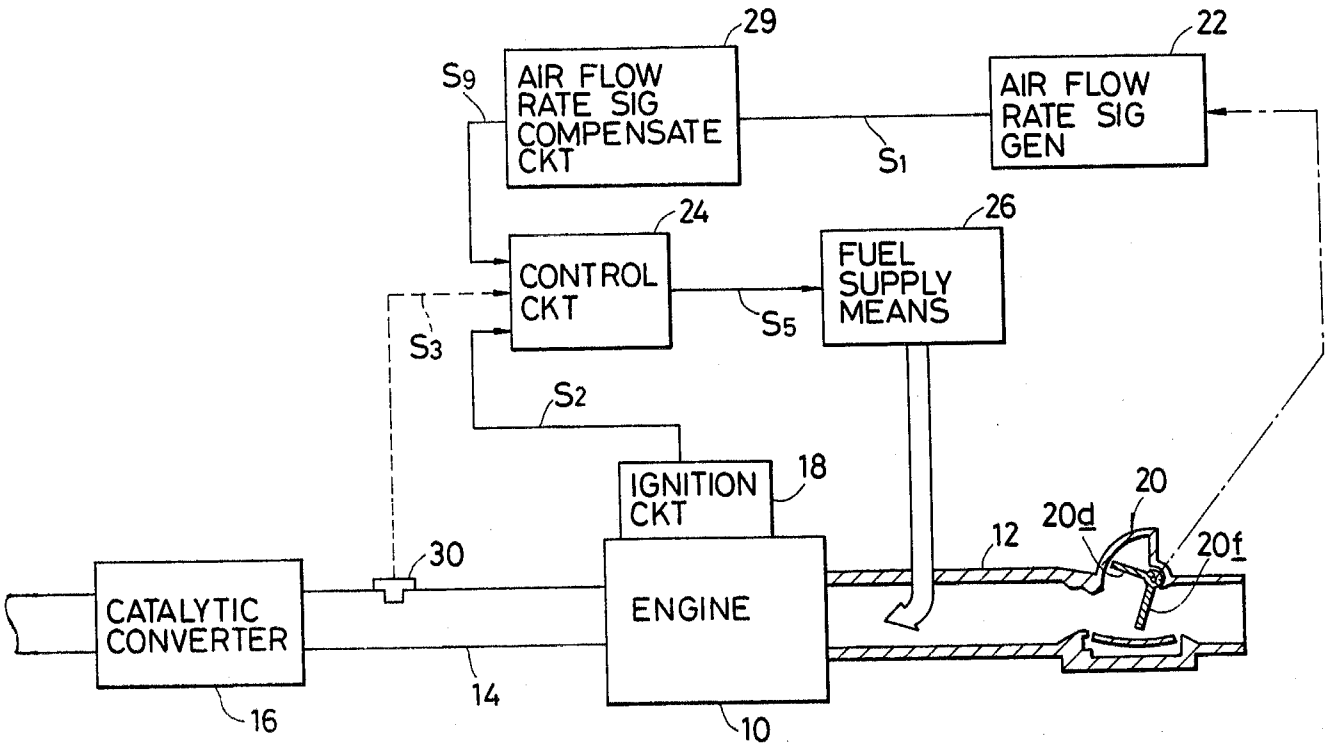
Figure 15:
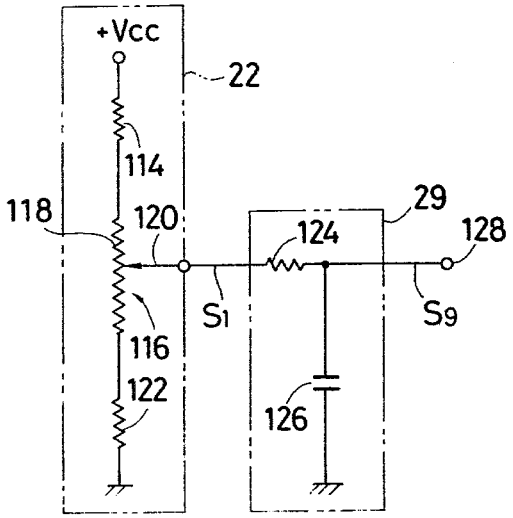
Figure 16:
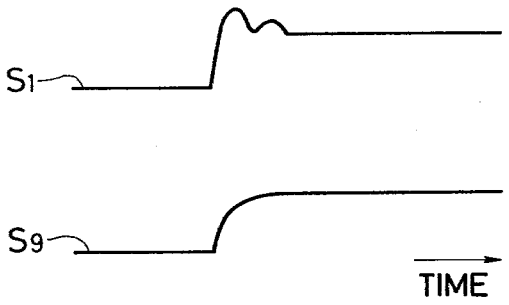

FIG. 10*a* and 10*b* show in waveform diagrams various signals obtained in the air flow rate signal compensation circuit shown in FIG. 9;

FIG. 11 shows in a schematic block diagram a second embodiment of the either open or closed loop air/fuel ratio control system according to the present invention;

FIG. 12*a* shows a first possible circuit of the control circuit shown in FIG. 11;

FIG. 12*b* shows a second possible circuit of the control circuit shown in FIG. 11;

FIG. 13*a*, FIG. 13*b*, FIG. 13*c* and FIG. 13*d* show in waveform diagrams various compensation signals obtained in the circuit shown in FIGS. 3, 5 and 9 and modified signals obtained in the control circuit shown in FIG. 12*b*;

FIG. 14 shows in a schematical block diagram a third embodiment of the either open or closed loop air/fuel ratio control system according to the present invention;

FIG. 15 shows circuitry of the air flow rate signal generator and the air flow rate signal compensation circuit both shown in FIG. 14;

FIG. 16 shows in a waveform diagram the input and output signals of the circuit shown in FIG. 15.

DETAILED DESCRIPTION OF THE PREFERRED EMBODIMENTS

Figure 1:
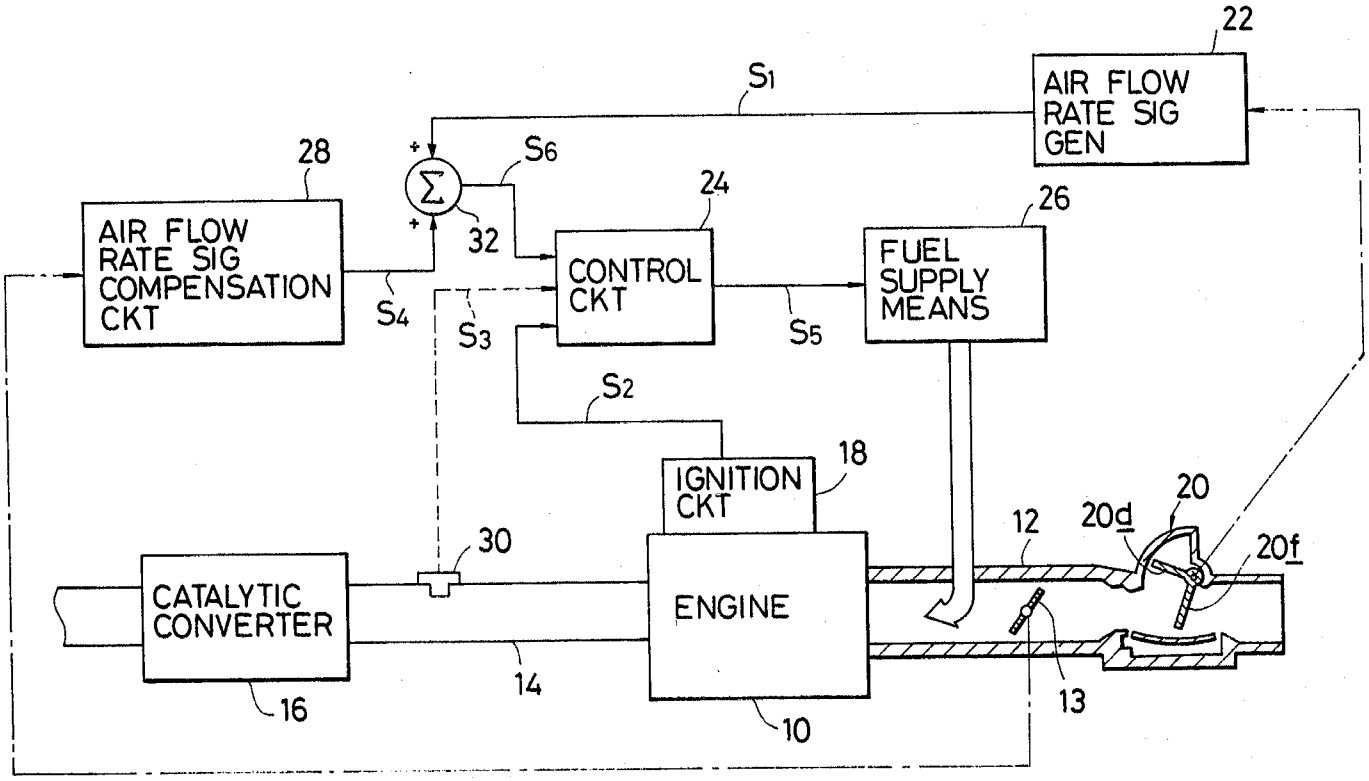
FIG. 1 shows in a schematical block diagram a first embodiment of the either open or closed loop air/fuel ratio control system according to the present invention.

FIG. 1 illustrates a first preferred embodiment of the open or closed loop air/fuel ratio control system according to the present invention. An internal combustion engine 10 is equipped with an intake manifold 12 in which a throttle valve 13 is disposed. The engine 10 is further equipped with an exhaust gas passage 14. A catalytic converter 16 such as three way catalytic converter which simultaneously reduces three components (CO, HC and NO) contained in the exhaust gases, is provided in the exhaust passage 14. An air flow meter 20 is disposed in the intake manifold 12 upstream of the throttle valve 13. The air flow meter 20 includes a flap **20*f* and a damper 20*d* where the flap 20*f* is arranged to rotate against ehf force of a spring (not shown) under the influence of the air pressure difference across the upstream and downstream sides of the flap 20*f*. The flap 20*f* is mechanically connected to an air flow rate signal generator 22 which includes a potentiometer (not shown in FIG. 1 but which is shown in FIG. 15). Since the movable contact (not shown) of the potentiometer is arranged to slide on a resistor of the potentiometer corresponding to the angular displacement of the flap 20*f***, *l the potentiometer produces an output signal* $S_1$ indicative of the air flow rate. However, because of the overshoot characteristics of the flap **20*f*** the signal $S_1$ is erroneous.

An ignition circuit 18 which includes a distributor (not shown) through which a high D.C. voltage is applied to the spark plugs (not shown) of the engine, is utilized for deriving a train of ignition pulses $S_2$. An air flow rate signal compensation circuit 28 includes a throttle valve movement sensor (not shown in FIG. 1 but which is shown in FIGS. 3, 5 and 9) which is connected to the throttle valve 13. The throttle valve movement sensor produces an output signal representative of the variation of the angular displacement of the throttle valve 13 so that the air flow rate signal compensation circuit 28 produces a compensation signal $S_4$ in response to the variation of the angular displacement of the throttle valve 13. The compensation signal $S_4$ of the air flow rate signal compensation circuit 28 and the output signal $S_1$ of the air flow rate signal generator 22 are supplied to an adder 32 or a summing circuit. These two signals $S_1$ and $S_4$ are added to each other and thus the adder 32 produces an output signal $S_6$ which is fed to a control circuit. This means that the signal $S_1$ is modified by the compensation signal $S_4$ to compensate for the overshoot characteristics of the air flow meter 20. The control circuit 24 is arranged to produce a control signal $S_5$ in response to the signal $S_6$ indicative of the actual air flow rate and the signal $S_2$ indicative of the engine speed. Fuel supply means 26 is connected to the control circuit 24 and thus an actuator (not shown) included in the fuel supply means 26 is controlled in response to the signal $S_5$. As the fuel supply means 26, a carburetor or an injection system can be utilized. With this provision the fuel flow rate supplied from the fuel supply means 26 is correctly determined without influence by the erroneous nature of the signal $S_1$.

The above mentioned construction of the air/fuel ratio control system is a so called "open loop" system. If the control circuit 24 produces the control signal $S_5$ in response to not only signals indicative of the air flow rate and the engine speed but also a signal indicative of the deviation of the air/fuel ratio from a desired value, the system is then a so called "closed loop" system since a feedback loop is provided. In the latter a gas sensor 30, such as a zirconium oxygen sensor, is provided in order to sense the concentration of a component in the exhaust gas passage 14. The gas sensor 30 produces an output signal $S_3$ indicative of the concentration and the signal $S_3$ is fed to the control circuit 24 as shown by a dotted line in FIG. 1.

Figure 2:
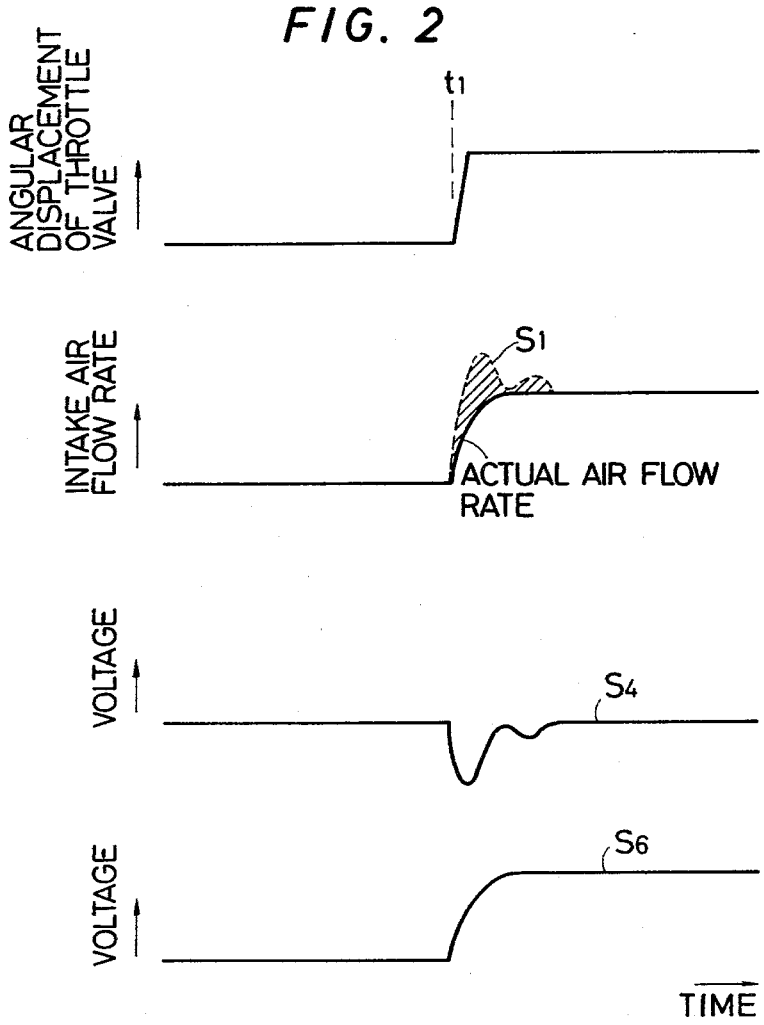
FIG. 2 shows graphs indicating the relationship between the actual air flow rate through the throttle valve shown in FIG. 1 and the detected air flow rate via the air flow meter corresponding to the variation of the angular displacement of the throttle valve and further shows an ideal compensation signal and the signal modified thereby.

Reference is now made to FIG. 2 which shows the relationship between the actual intake air flow rate and the air flow rate indicated by the signal $S_1$ produced in the air flow rate signal generator 22. The first graph in FIG. 2 shows the variation of the angular displacement of the throttle valve 13. Assuming the throttle valve 13 opens abruptly at time "$t_1$", the flow rate of the intake air increases as shown by the second graph. However, because of the overshoot characteristics of the flap **20*f* the magnitude of the signal $S_1$ produced by the air flow rate signal generator 22 varies as shown by the dotted line. The air flow rate signal compensation circuit 28 shown in FIG. 1 is utilized to compensate for the overshoot error shown by cross hatched area in FIG. 2. The third graph shows an ideal compensation signal $S_4'$ which is preferably added to the signal $S_1$. As the result the adder 32 produces signal $S_6$ which corresponds closely to the actual air flow rate as shown in the fourth graph of FIG. 2. Therefore, it is to be understood that the air flow rate signal compensation circuit 28 is utilized to produce a signal such a signal $S_4'$ shown in the third graph in FIG. 2, with which the erroneous portion of signal $S_1$ shown in the second graph is canceled. Since it requires complex circuitry to produce such an ideal signal $S_4'$ the waveform of which is exactly same as the third graph, the air flow rate signal compensation circuit 28** is arranged to produce the output signal $S_4$ the waveform of which is approximately the same as that of the signal $S_4'$.

FIG. 3 illustrates a first possible circuit 28*a* of the air flow rate signal compensation circuit 28 shown in FIG. 1. Two resistors 40 and 42 are connected in series between a positive power supply +Vcc and ground. A switch 44 is connected in parallel with the resistor 42, i.e., between a junction between the resistors 40 and 42 and ground. This switch 44 is arranged to be operated in response to the movement of the throttle valve 13 shown in FIG. 1 where the switch 44 opens (becomes OFF) when the angular displacement of the throttle valve 13 is minimal, i.e., in an idling position, and closes (becomes ON) during other states of the throttle valve 13. A resistor 46 is interposed between the junction and the base of a transistor 48 the emitter of which is connected to ground. The collector of the transistor 48 is connected via resistor 50 to the positive power supply +Vcc while the collector of same is connected via a capacitor 52 to the input of an inverter 60. A resistor 54 is interposed between the input of the inverter 60 and ground while the input is connected to a terminal 66. The output of the inverter 60 is connected to an output terminal 64 of the circuit 28*a*.

Figure 4:
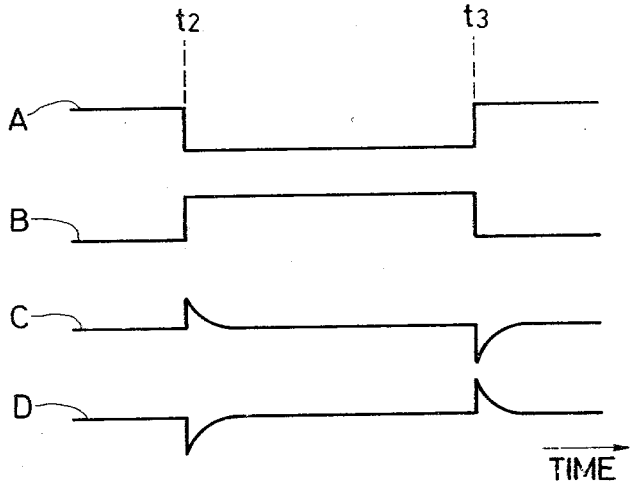
FIG. 4 shows in a waveform diagram various signals obtained in the circuit shown in FIG. 3.

Now the function and operation of the circuit 28*a* shown in FIG. 3 will be described with reference to the waveforms shown in FIG. 4. The voltage at the junction between the two resistors 40 and 42 is denoted by "A" in FIG. 4. The voltage "A" is produced by the voltage divider consisting of the two resistors 40 and 42 only while the switch 44 is open. With this arrangement, the transistor 48 is conductive while the switch 44 is open and thus the voltage "B" at the collector of same assumes a low level. The capacitor 52 and the resistor 54 form a differentiation circuit. Upon closure of the switch 44 the transistor 48 becomes nonconductive at time "$t_2$" since the voltage at the base of same is low. As soon as the transistor 48 becomes nonconductive, the voltage "B" at the collector of the transistor 48 becomes high so that the differentiation circuit produces a differentiated signal "C". When the switch 44 opens again at time "$t_3$", the transistor 48 becomes conductive in the same manner and thus the differentiation circuit produces a negative differentiated signal. Both of the positive and negative differentiated signals "C" are then fed to the inverter 60 and thus the positive and negative differentiated signals are respectively inverted into negative and positive signals "D". The output signals "D" respectively produced at time "$t_2$" and time "$t_3$", are then fed to the adder 32 shown in FIG. 1 via the output terminal 64.

Since the switch 44 closes when the throttle valve 13 opens from the idling position thereof, i.e., the engine 10 shown in FIG. 1 is accelerated from the idling state, a negative output signal "D" is produced at the initial time of the acceleration. In the same manner a positive output signal "D" is produced at the initial time "$t_3$" of the deceleration because the switch 44 opens when the throttle valve 13 closes. As shown in FIG. 1, the output terminal 64 shown in FIG. 3 is connected to the adder 32 for applying the output signal "D" as the compensation signal $S_4$. Therefore, the output signal $S_1$ of the air flow rate signal generator 22 is desirably modified.

If such a compensation signal is preferable generated only upon the acceleration of the engine 10, a diode 56 may be interposed between the input of the inverter 60 and ground as shown by a dotted line in FIG. 3. With this arrangement no negative differentiation signal such as the signal "C" at time "$t_3$" shown in FIG. 4 is produced. Further, if such a compensation signal had better not be produced upon some specific engine conditions, the circuit 28*a* can be disabled by connecting the terminal 66 to ground.

Reference is now made to FIG. 5 which shows a second possible circuit 28*b* of the air flow rate signal compensation circuit 28 shown in FIG. 1. A throttle valve movement sensor 68 includes a semicircular insulating member 74, conductors 72 and a rotatable member 70. The rotatable member 70, such as a brush, is connected to the throttle valve 13 shown in FIG. 1 and is arranged to rotate corresponding to the variation of the angular displacement of the throttle valve 13. On the semicircular insulating member 74 a plurality of conductors 72 are disposed so that the rotatable member 70 slides on the conductors 72. All of the conductors 72 are connected to each other and further to the positive power supply +Vcc. Therefore, a train of pulses is produced when the rotatable member 70 slides on the conductors 72.

The throttle valve movement sensor 68 is connected to the input of a differentiation circuit 76 the output of which is connected to the input of a first monostable multivibrator 78. However, the train of pulses is arranged to be transmitted to the differentiation circuit 76 only when the rotatable member 70 rotates clockwise. The detailed description of the throttle valve movement sensor 68 will be made later. The above mentioned throttle valve movement sensor 68, the differentiation circuit 76 and the first monostable multivibrator 78 constitute a pulse generator (no numeral). The output of the first monostable multivibrator 78 is connected via a series circuit of a diode 80 and a resistor 82 to the inverting input of an operational amplifier 84 while same output of the first monostable multivibrator 78 is further connected to the input of a second monostable multivibrator 90 the pulse width of which is greater than that of the first monostable multivibrator 78. The noninverting input of the operational amplifier 84 is connected to a terminal 100 at which a predetermined voltage $V_B$ is applied. A capacitor 86 is interposed across the output and the inverting input of the operational amplifier 84 so that the operational amplifier 84 functions as an integration circuit. An ON-OFF type switch 88 is connected in parallel across the capacitor 86 where the switch 88 is controlled in response to the output signal of the second monostable multivibrator 90. The output of the operational amplifier 84 is connected via a resistor 92 to an output terminal 101 of the circuit 28*b*. Above mentioned elements constitute an acceleration detecting circuit the function of which will be described hereinafter and almost same circuit, which is referred to as a deceleration detecting circuit, is connected in parallel with the acceleration detecting circuit.

The deceleration detecting circuit includes a throttle valve movement sensor 68', a differentiation circuit 76', a first monostable multivibrator 78', a second monostable multivibrator 90', a series circuit of a diode 80' and a resistor 82', an integration circuit including a first operational amplifier 84' and a capacitor 86', an ON- OFF type switch 88', which are connected in the same manner as in the acceleration detecting circuit, and an inverting circuit including a second operational amplifier 94 and a feedback resistor 96 connected across the output and the inverting input of the second operational amplifier 94 the inverting input of which is connected via a resistor 92' to the output of the first operational amplifier 84'. The throttle valve movement sensor 68' has a similar construction to the throttle valve sensor 68 of the acceleration detecting circuit where the conductors 72' are connected to each other and further to the positive power supply +Vcc. The train of pulses produced at the rotatable member 70' is arranged to be transmitted to the differentiation circuit 76' only when the rotatable member 70' rotates counterclockwise. The noninverting inputs of the first and second operational amplifiers 84' and 94 are connected to the terminal 100. The output of the second operational amplifier 94 is connected via a resistor 98 to the output terminal 101.

Figure 6:
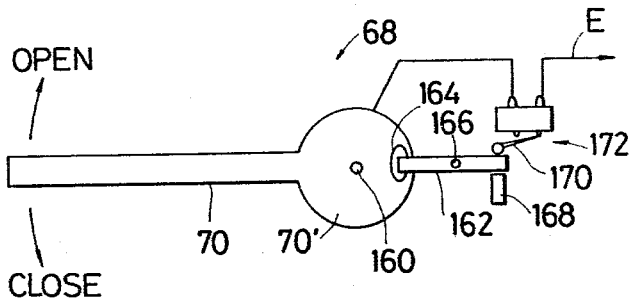
FIG. 6 shows the throttle valve movement sensor shown in FIG. 5.

Reference is now made to FIG. 6 which shows the detailed construction of the throttle valve sensor 68. In FIG. 6 the semicircular insulating member 74 and the conductors 72 both shown in FIG. 5 are not shown. The rotatable member 70 is made of a conductive material and is electrically connected to a terminal of a micro switch 172. The rotatable member 70 has a disk like portion 70' the center of which is rotatably mounted on a fixed member (not shown) via a shaft 160. A seesaw type lever 162 is rotatably disposed via a shaft 166 on the fixed member between the disk like portion 70' and a movable lever 170 of the micro switch 172. On the left end of the lever 162 in FIG. 6 a friction pad 164 is fixedly attached. A stopper 168 is fixedly connected to the fixed member where the upper surface of the stopper 168 is arranged to be a predetermined distance from the micro switch 172 so that the possible travel of the lever 162 is limited. The friction pad 164 is arranged to contact to the surface of the disk like portion 70' via a spring (not shown). Therefore, the lever 162 tends to rotate clockwise or counterclockwise corresponding to the movement of the rotatable member 70.

Assuming the rotatable member 70 rotates clockwise, upon opening of the throttle valve 13 shown in FIG. 1, the lever 162 tends to rotate counterclockwise so that the upper surface of the right hand of the lever 162 presses the movable lever 170 of the micro switch 172. As soon as the movable lever 170 is pressed the micro switch becomes conductive so that the pulses produced at the rotatable member 70 is transmitted as the signal E shown in both FIGS. 5 and 6. The friction pad 164 is arranged to slide on the surface of the disk like portion 70' since the movable lever 170 can not move more than a small predetermined distance. This means that the micro switch 172 is conductive while the rotatable member 70 rotates clockwise or stops after moving clockwise. Assuming the rotatable member 70 rotates counterclockwise upon closing of the throttle valve 13, the lever 162 tends to rotate clockwise so that the micro switch 172 becomes nonconductive. However, because of the stopper 168 the lever 162 does not move more than a predetermined distance and then the friction pad 164 slide on the surface of the disk like portion 70'. Though FIG. 6 illustrates only the throttle valve sensor 68, the other throttle valve sensor 68' is constructed in the same manner in which the train of pulses produced at the rotatable member 70' is transmitted via a micro switch when the throttle valve 13 closes or remains stationally after closing. If the stopper 168 shown in FIG. 6 is substituted with another micro switch (not shown), the switch can be utilized for transmitting the train of pulses when the throttle valve closes. With this arrangement of two micro switches the rotatable member 70 as well as the conductors 72 can be utilized for both the acceleration circuit and the deceleration circuit since two switches closes alternatively in accordance with the directions of the movement of the rotatable member 70.

Although FIG. 5 and FIG. 6 show the construction of the throttle valve sensor 68 and/or 68', the throttle valve sensors 68 and 68' can be substituted with other arrangements. For instance, a shutter in the form of a disc formed with a plurality of apertures formed about the periphery thereof which are arranged to cut a beam of light transmitted from a light source to a photo sensitive cell can be utilized for detecting the variation of the angular displacement of the throttle valve 13.

The functions and the operations of the circuit **28*b* shown in FIG. 5 will be described hereinafter with reference to the waveforms shown in FIG. 7 and FIG. 8**.

Figure 7:
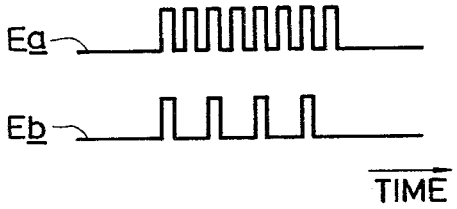
FIG. 7 and FIG. 8 show in waveform diagrams various signals obtained in the circuit shown in FIG. 5.
Figure 8:
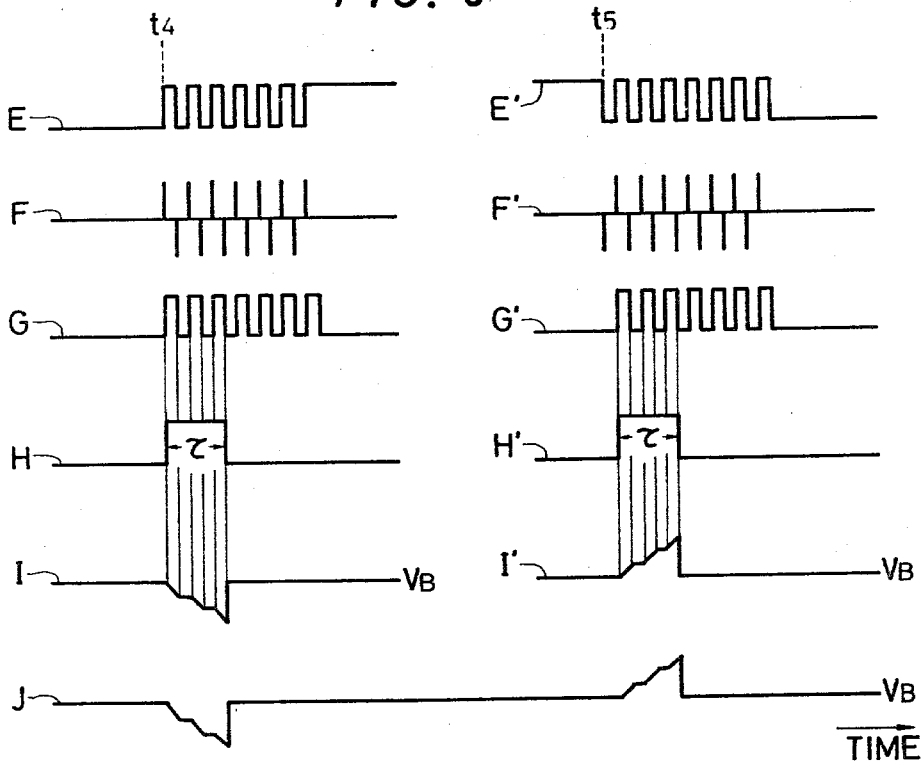

Assuming the throttle valve 13 opens or closes rapidly, the train of pulses obtained at the rotatable member 70 or 70' assumes high frequency as indicated by Ea in FIG. 7. If the throttle valve 13 opens or closes more slowly the waveform of the train of pulses is like signal Eb in FIG. 7. This means that the number of pulses produced per a unit time is determined by the speed of the rotational movement of the rotatable member 70 or 70', i.e., the opening or closing speed of the throttle valve 13.

Though the signals Ea and Eb shown in FIG. 7 assume high and low levels only when the pulses are produced, the signal at the rotatable member 70 may assume a high level even when pulses are not produced, since the rotatable member 70 may stop and stay on one of the conductors 72. Signals "E" and "E'" shown in FIG. 8 show such a state.

Signals "E" to "I" inclusive are produced in the acceleration detecting circuit while signals "E'" to "I'" inclusive are produced in the deceleration detecting circuit and thus a signal "J" is produced at the output terminal 101 of the circuit **28*b*. Assuming the throttle valve 13 opens, a train of pulses "E" is produced at time "$t_4$" and is fed to the differentiation circuit 76 which produces a differentiated signal "F" as shown in FIG. 8, corresponding to the leading edges and the trailing edges of the pulses of signal "E". The differentiated signal "F" is fed to the first monostable multivibrator 78 to trigger same so that the first monostable multivibrator 78 produces a train of pulses "G" as shown. This pulse signal "G" is fed to the integration circuit consists of the operational amplifier 84 and the capacitor 86. Simultaneously the train of pulses "G" produced in the first monostable multivibrator 78 is fed to the second monostable multivibrator 90 so that the second monostable multivibrator 90 produces a pulse "H" in response to the leading edge of the first pulse among pulses "G" applied thereto. The pulse width of the pulse "H" is denoted by "$\tau$". Since the switch 88 is arranged to open (becomes OFF) in response to the pulse signal "H", the integration circuit operates only while the pulse signal "H" is present. Therefore, the integration circuit integrates the pulse signal "G" for a period of time determined by the pulse width of the pulse "H". The output signal "I" of the integration circuit, i.e., the output of the operational amplifier 84, is then fed via the resistor 92 to the output terminal 101**.

If the throttle valve 13 tends to close, a train of pulses "E'" is produced at time "$t_5$" and is fed to the differentiation circuit 76' of the deceleration detecting circuit. The deceleration detecting circuit functions similarly to the acceleration detecting circuit except that the integrated signal at the output of the first operational amplifier 84' is inverted by the second operational amplifier 94. Since all of the noninverting inputs of the operational amplifiers 84, 84' and 94 are supplied with a predetermined voltage $V_B$, the signal "I" is negative while the other signal "I'" is positive relative to the predetermined voltage $V_B$. The output signal "J" is produced by adding above mentioned two signals "I" and "I'". The output signal "J" is utilized as the compensation signal $S_4$ shown in FIG. 1. and thus is fed to the adder 32. Therefore, the air flow rate signal $S_1$ is modified by the signal $S_4$, i.e., signal "J", in the same manner as in the first circuit shown in FIG. 3. With this provision, the overshoot characteristic of the flap **20*f* of the air flow meter 20** is compensated for.

FIG. 9 illustrates the third possible circuit **28*c* of the air flow rate signal compensation circuit 28 shown in FIG. 1. A potentiometer 102 is consists of a resistor 104, a movable member 106 which slides on the resistor 104, and a battery 108 connected across the resistor 104. The movable member 106 is arranged to rotate corresponding to the variation of the angular displacement of the throttle valve 13, viz., the movable member 106 rotates clockwise when the throttle valve 13 opens and rotates counterclockwise when the throttle valve 13 closes. The negative terminal of the battery 108 is connected to ground while the movable member 106 is connected to the input of a differentiation circuit 110. The output of the differentiation circuit 110 is connected via an inverting circuit 111 to an output terminal 112 of the circuit 28*c***.

The function and the operations of the circuit **28*c* shown in FIG. 9, will be described hereinafter with reference to the waveforms shown in FIG. 10*a* and FIG. 10*b*. As the movable member 106 slides clockwise on the resistor 104, the voltage "N" at the input of the differentiation circuit increases at time "$t_6$". Upon closure of the throttle valve 13 the movable member 106 rotates counterclockwise so that the voltage "N" decreases at time "$t_7$". The differentiation circuit 110 produces a differentiated signal "P" in response to the leading edges and the trailing edges of the voltage "N". The differentiated signal "P" is then inverted and thus an inverted output signal "Q" is produced at the output terminal 112. This output signal "Q" is utilized as the compensation signal $S_4$ shown in FIG. 1 by connecting the output terminal to the adder 32**. Therefore, the air flow rate signal $S_1$ is modified by the compensation signal $S_4$, i.e., signal "Q" in the same manner as in the previous circuits.

FIG. **10*b* illustrates like signals as shown in FIG. 10*a* where the variation of the voltage "N" per unit time obtained by the potentiometer 102 is smaller than that shown in FIG. 10*a*. This means that the throttle valve 13 opens or closes relatively slowly. Since the increase and decrease rate of the signal "N" is relatively small, the magnitude of the differentiated signal "P" is small. With this arrangement, the magnitude of the compensation signal is determined by the rotational speed of the throttle valve 13. This arrangement is advantageous since the overshoot characteristic of the flap 20*f* of the air flow meter 20 varies in response to the rapidity with which the throttle valve 13 is opened or closed, viz., if the throttle valve 13 moves gradually, the overshoot characteristics of the flap 20*f* is negligible, but if the same moves rapidly, the overshoot characteristics of the flap 20*f*** is great.

FIG. 11 illustrates the second embodiment of the either open or closed loop air/fuel ratio control system according to the present invention. The system shown in FIG. 11 is same in construction as in FIG. 1 except that the outputs of the air flow rate signal generator 22 and the air flow rate signal compensation circuit 28 are directly connected to the control circuit 24. As the air flow rate signal compensation circuit 28, any one of the before mentioned circuits shown in FIGS. 3, 5 and 9 can be utilized. In other words, the air flow rate signal compensation circuit 28 produces the compensation signal $S_4$ in response to the variation of the angular displacement of the throttle valve 13 in the same manner as in the first embodiment.

FIG. **12*a* illustrates a first possible circuit 24*a* of the control circuit 24 shown in FIG. 11. The circuit 24*a* is arranged to produce a control signal $S_5$ which is a train of pulses. The circuit 24*a* includes a pulse generator 200 and a PWM (pulse width modulation) signal generator 202. The pulse generator 200 produces a train of pulses $S_7$ in response to the signals $S_1$ and $S_2$. Since the signal $S_1$ may be erroneous as mentioned before because of the overshoot characteristic of the flap 20*f*, the pulse width of the pulses $S_7$ may be erroneous. These pulses $S_7$ are fed to the PWM signal generator 202 which produces a train of pulses the pulse width of which is modified in response to the signal $S_4$ fed from the air flow rate signal compensation circuit 28. Therefore, the erroneous nature of in the signal $S_7$ is desirably corrected by the signal $S_4$ so that the output pulses of the PWM signal generator 202 are utilized as the control signal $S_5$ with which the fuel supply means 26** is controlled, i.e. for instance the fuel flow rate is proportion to the pulse width.

FIG. **12*b* illustrates another possible circuit 24*b* of the control circuit 24 shown in FIG. 11. The circuit 24*b* includes a pulse generator 200, a PWM signal generator 202, a comparator 180, a proportional signal generator 182, an integration signal generator 184, and an adder 186. The connection of the pulse generator 200 and the PWM signal generator 202 is the same as in the circuit 24*a* shown in FIG. 12*a* except that the pulse width of the pulses $S_7$ is modified in response to the output signal $S_8$ of the adder 186**.

One input of the comparator 180 is connected to the gas sensor 30 shown in FIG. 11 while the other input of the comparator 180 is supplied with a reference signal $S_r$ so that the comparator 180 produces an output signal in response to the variation of the gas sensor output signal $S_3$ by comparing the magnitude of the signal $S_3$ with the reference signal $S_r$. The proportional signal generator 182 and the integration signal generator 184 both connected to the output of the comparator 180, constitute a so called P-I controller. The ouputs of the proportional signal generator 182 and the integration signal generator 184 are respectively connected to the adder 186. Above mentioned feedback control system is well known, where the output of such an adder is utilized for modifying the air/fuel ratio. According to the present invention, however, the compensation signal $S_4$ (D, J or Q) is further applied to the adder 186 so that a signal produced by adding the outputs of the proportional signal generator 182 and the integration signal generator 184 is modified by the compensation signal $S_4$. With this provision, the adder 186 produces an output $S_8$ which is fed to the PWM signal generator 202 so that the PWM signal generator 202 produces a control signal $S_5$ without influence of the overshoot characteristic of the flap 20*f* of the air flow meter 20.

Figure 13A:
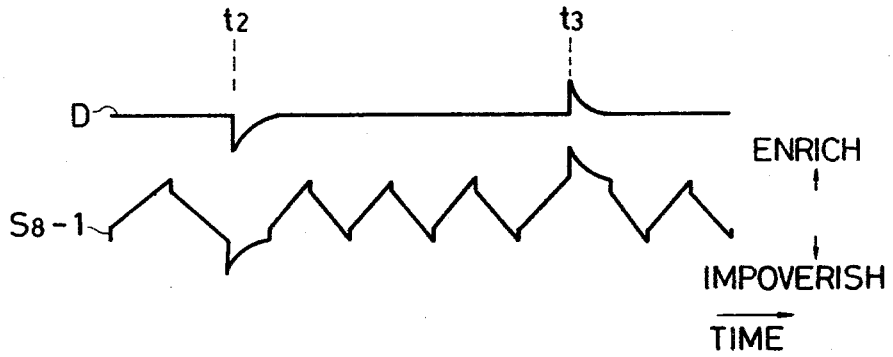
Figure 13B:
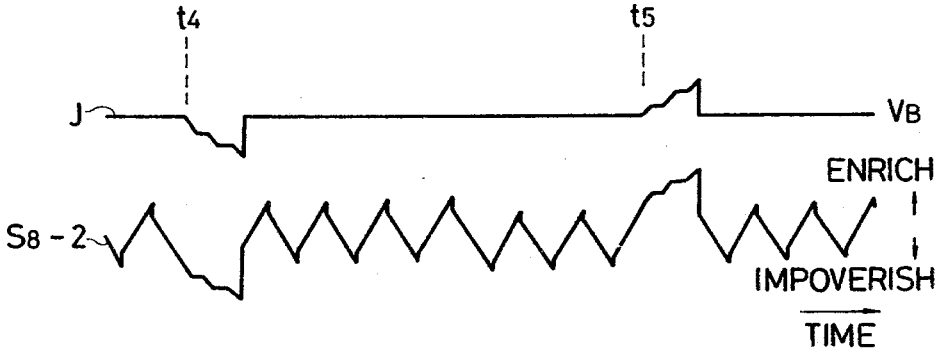
Figure 13C:
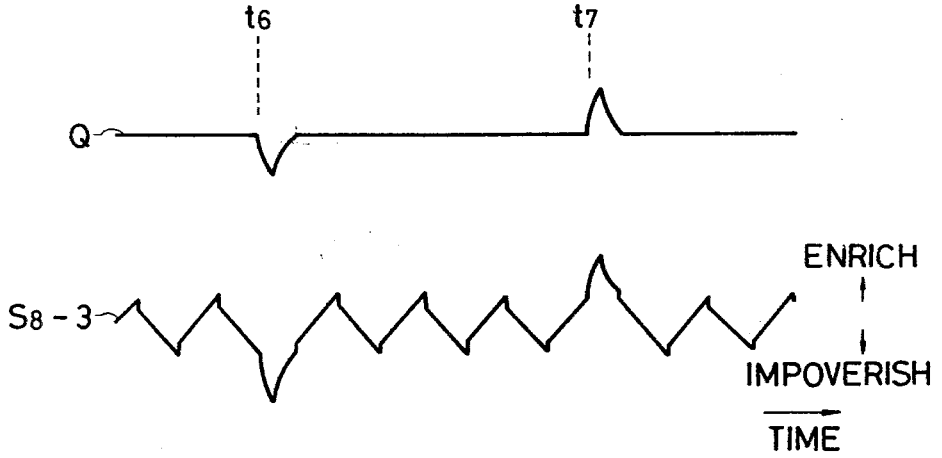

Reference is now made to FIGS. 13*a*, 13*b* and 13*c* which show the relationship between the signal $S_4$ and the signal $S_8$. FIG. 13*a* illustrates signal "D" produced in the circuit 28*b* shown in FIG. 3, which is utilized as the signal $S_4$ shown in FIG. 12*b* and a signal $S_8$-1 produced in the adder 186 as the signal $S_8$. The level of the signal "D" falls below normal at time "$t_2$" corresponding to the opening of the throttle valve 13 as mentioned before, and thus the output $S_8$-1 of the adder 186 falls at time "$t_2$" corresponding to the signal "D". This means that the PWM signal generator 202 produces the output pulses the pulse width of which is shorter than that produced without such a compensation signal $S_4$. Therefore, the errors included in the signal $S_7$ because of the overshoot characteristic of the flap 20*f* is desirably compensated for. In the same manner, the errors are compensated for at time "$t_3$" where the pulse width of the pulses $S_5$ becomes wider corresponding to the closure of the throttle valve 13.

FIG. 13*b* and FIG. 13*c* show such a relationship between the signal $S_4$ (J and Q) and the signal $S_8$ ($S_8$-2 and $S_8$-3) when the circuit shown in FIG. 5 or FIG. 9 utilized as the air flow rate signal compensation circuit 28.

Reference is now made to FIG. 14 which shows the third embodiment of the either open or closed loop air fuel ratio control system according to the present invention. The system shown in FIG. 14 is the same as that shown in FIG. 1 except that an air flow rate signal compensation circuit 29 is interposed between the output of the air flow rate signal generator 22 and one of the inputs of the control circuit 24 instead of the air flow rate signal compensation circuit 28 connected to the throttle valve 13 as in FIG. 1 and FIG. 11. The air flow rate signal compensation circuit 29 is arranged to modify the output signal $S_1$ of the air flow rate signal generator 22 and thus produces a modified air flow rate signal $S_9$ so that the control circuit 24 produces a control signal $S_5$ which is not erroneous due to the overshoot characteristics of the flap 20*f* of the air flow meter 20.

FIG. 15 illustrates a circuitry of the air flow rate signal generator 22 and the air flow rate signal compensation circuit 29 shown in FIG. 14. Three resistors 114, 118 and 122 are connected in series and are interposed between the positive power supply +Vcc and ground where the resistor 118 and a movable contact 120 which slides on the resistor 118 constitute a potentiometer 116. The movable contact 120 of the potentiometer 116 is arranged to rotate corresponding to the rotational movement of the flap 20*f* of the air flow meter 20. The air flow rate signal compensation circuit 29 includes a resistor 124 interposed between the movable contact 120 and the output terminal 128 of the circuit 29 and a capacitor 126 interposed between the output terminal 128 and ground. The resistor 124 and the capacitor 126 form a smoothing circuit where the resistance of the resistor 124 and the capacitance of the capacitor 126 are selected so that the smoothing circuit functions desirably reducing the overshoot voltages included in the signal $S_1$.

FIG. 16 illustrates two waveforms of signals $S_1$ and $S_9$ obtained in the circuitry 22 and 29 shown in FIG. 15. Because of the overshoot characteristic of the flap 20*f* of the air flow meter 20 the signal $S_1$ indicative of the air flow rate has an overshoot voltage. However, the overshoot voltage resides in the signal $S_1$ is desirably reduced by the smoothing circuit so that an output signal $S_9$, which does not include such an overshoot voltage is produced at the output terminal 128.

The output voltage, $S_9$ is then supplied to the control circuit 24 shown in FIG. 14 and thus the control circuit 24 produces the control signal $S_5$ the magnitude of which is not influenced by the overshoot characteristic of the flap 20*f*. Though FIG. 16 illustrates signal $S_1$ and $S_9$ corresponding to the acceleration of the engine 10, it is obvious that the smoothed signal $S_9$ is similarly produced upon deceleration of the engine. Therefore, the air/fuel ratio of the air-fuel mixture is desirably controlled in the same manner as in the previous embodiments.

What is claimed is:

1. An air/fuel ratio control system for an internal combustion engine including an air flow meter having a flap disposed in the intake passage of said engine, an air flow rate signal generator for producing a first signal indicative of the intake air flow rate in response to the movement of said flap, a control circuit for producing a second signal in response to the first signal and other engine parameters, and fuel supply means for supplying fuel into said intake passage of said engine, the fuel flow rate being controlled in accordance with said second signal, wherein the improvement comprises:

an air flow rate signal compensation means for producing a third signal with which one of said first and second signals is modified for electronically compensating for the overshoot characteristic of said flap in response to the variation of the intake air flow rate, said air flow rate signal compensation means including:

(a) an ON-OFF type switch for detecting whether the angular displacement of the throttle valve of said engine is above a predetermined value or not;

(b) a differentiation circuit for differentiating the output signal of said ON-OFF type switch; and (c) means for applying a predetermined voltage to the output of said differentiation circuit for disabling said air flow rate signal compensation means.

2. A system as claimed in claim 1, further comprising rectifier means for selectively blocking one of positive and negative differentiated signals.

3. A system as claimed in claim 1, further comprising an inverting circuit responsive to the output signal of said differentiation circuit.

4. A system as claimed in claim 1, wherein said electronic means further comprises an adder connected to the output of said air flow rate signal generator and to said air flow rate signal compensation circuit for producing a fourth signal by adding said first and third signals to each other, said fourth signal being supplied to said control circuit.

5. An air/fuel ratio control system for an internal combustion engine including an air flow meter having a flap disposed in the intake passage of said engine, an air flow rate signal generator for producing a first signal indicative of the intake air flow rate in response to the movement of said flap, a control circuit for producing a second signal in response to said first signal and other engine parameters, and fuel supply means for supplying fuel into said intake passage of said engine, the fuel flow rate being controlled in accordance with said second signal, wherein the improvement comprises:

an air flow rate signal compensation means for producing a third signal with which one of said first and second signals is modified for electronically compensating for the overshoot characteristic of said flap in response to the variation of the intake air flow rate, said air flow rate signal compensation means including:

(a) pulse generating means for producing a first train of pulses in response to a first direction of the movement of the throttle valve of said engine and a second train of pulses in response to a second direction of the movement of said throttle valve, the number of pulses per unit time indicating the variation speed of the angular displacement of said throttle valve; and (b) an electronic circuit responsive to said first and second trains of pulses for producing said third signal.

6. A system as claimed in claim 5, wherein said pulse generating means comprises first and second pulse generators respectively connected to the throttle valve and first and second switches respectively connected to said pulse generators, said first switch becoming ON and said second switch becoming OFF upon a first direction of the movement of said throttle valve while said second switch becomes ON and said first switch becomes OFF upon a second direction of the movement of said throttle valve.

7. A system as claimed in claim 5, wherein said pulse generating means comprising a pulse generator connected to said throttle valve and first and second switches respectively connected to said pulse generator, said first switch becoming ON and said second switch becoming OFF upon a first direction of the movement of said throttle valve while said second switch becomes ON and said first switch becomes OFF upon a second direction of the movement of said throttle valve.

8. A system as claimed in claim 5, wherein said pulse generating means comprises a plurality of conductors disposed on a semicircular insulating member, said conductors being supplied with a predetermined voltage, and a movable member arranged to slide on the conductors in response to the movement of the throttle valve.

9. A system as claimed in claim 5, wherein said pulse generating means further comprises first and second differentiation circuits for respectively producing first and second differentiated signals in response to said first and second trains of pulses, and first and second monostable multivibrators respectively connected to said first and second differentiation circuits for producing third and fourth trains of pulses in response to said first and second differentiated signals.

10. A system as claimed in claim 9, wherein said electronic circuit comprises first integration circuit connected to said first monostable multivibrator, a first ON-OFF type switch connected across said first integration circuit, a third monostable multivibrator connected to said first monostable multivibrator the output pulse width of which being greater than that of said first monostable multivibrator, said first ON-OFF type switch being arranged to become OFF in response to a pulse produced in said third monostable multivibrator, second integration circuit connected to said second monostable multivibrator, a second ON-OFF type switch connected across said second integration circuit, a fourth monostable multivibrator connected to said second monostable multivibrator the output pulse width of which being greater than that of said second monostable multivibrator, said second ON-OFF type switch being arranged to become OFF in response to a pulse produced in said fourth monostable multivibrator, an inverting circuit connected to said second integration circuit, and an adder connected to the output of said first integration circuit and to the output of said inverting circuit.

* * * * *